US010388194B2

(12) United States Patent
Wilkinson, Jr.

(10) Patent No.: US 10,388,194 B2
(45) Date of Patent: Aug. 20, 2019

(54) SIGNAGE PANEL WITH BASE

(71) Applicant: EPS Specialties Ltd., Inc., Cincinnati, OH (US)

(72) Inventor: Lee E. Wilkinson, Jr., Cincinnati, OH (US)

(73) Assignee: EPS Specialties Ltd., Inc., Cincinnati, OH (US)

( * ) Notice: Subject to any disclaimer, the term of this patent is extended or adjusted under 35 U.S.C. 154(b) by 0 days.

(21) Appl. No.: 15/871,370

(22) Filed: Jan. 15, 2018

(65) Prior Publication Data

US 2019/0221141 A1 Jul. 18, 2019

(51) Int. Cl.
*G09F 7/18* (2006.01)

(52) U.S. Cl.
CPC ..... *G09F 7/18* (2013.01)

(58) Field of Classification Search
CPC ..... G09F 7/18; G09F 2007/1856
USPC ..... 248/310, 317, 320, 343
See application file for complete search history.

(56) References Cited

U.S. PATENT DOCUMENTS

| | | | | |
|---|---|---|---|---|
| 1,773,488 A * | 8/1930 | Hines | E01F 9/602 | 404/10 |
| 2,551,157 A * | 5/1951 | Price | G09F 7/18 | 248/231.41 |
| 5,215,285 A * | 6/1993 | Lewis | G09F 1/14 | 248/457 |
| 5,409,191 A * | 4/1995 | Wenmaekers | E04B 9/006 | 248/317 |
| 9,747,818 B1 * | 8/2017 | Benedict | G09F 7/18 | |
| 10,002,552 B1 * | 6/2018 | Gologursky | G09F 13/18 | |

* cited by examiner

*Primary Examiner* — Muhammad Ijaz
(74) *Attorney, Agent, or Firm* — Wood Herron & Evans LLP

(57) ABSTRACT

A signage panel system comprises a panel element and a base element. The panel element has at least one tab formed on an edge and the tab including a slot formed therein. The base element including at least one channel formed therein wherein the channel is configured to receive the tab of the panel element when the panel element engages with the base element. A planar slide lock element fits into the tab slot of the panel element and slides in the tab slot. The channel has a wide section and a narrow section adjacent the wide section, the tab configured for engaging the channel with the slide lock element positioned in the wide section of the channel. The slide lock element sliding in the tab slot and in the channel to engage the narrow section and secure the panel element with the base element.

18 Claims, 8 Drawing Sheets

SIGNAGE PANEL WITH BASE

FIELD OF INVENTION

This invention relates to systems and methods for panels used for signs, displays and the like used to advertise or identify merchandise in a retail environment, such as a supermarket or big box retailer.

BACKGROUND OF THE INVENTION

Various displays are commonly used in retail environments to identify and promote merchandise or to display other information about goods or services offered in the retail environment. Such displays are an effective way to capture the attention of retail customers and make a particular product or service stand out, thereby increasing sales of that product. Such displays may be permanent or temporary, depending on the nature of the promotion.

In various environments, such as in "big box" stores or supermarkets, signage and displays are often hung or suspended from the ceiling or from ceiling structures, to rest at a lower height for being seen and read by customers. The weight of such displays and the structures used for suspension are therefore issues that must be addressed for any display or sign.

For example, overhead panels may be connected to a ceiling to provide a vertical mounting surface for advertising information, menu information, or other displays in various retail establishments. The overhead panels must have substantial thickness in order to achieve the desired effect. However, the weight of some existing overhead panels requires significant structural elements mounted to a ceiling of the building. Many overhead panels also must be installed using hoists or similar mechanical lifting devices.

Furthermore, in many buildings, such as "big box" buildings having very high structural ceilings, a so-called drop ceiling is installed below the higher structural ceiling and duct work. The drop ceiling might define an area such as a food court, customer service area, or smaller retail area within the larger store. The drop ceiling includes a plurality of ceiling support members suspended from the higher ceiling and interconnected to form a grid in a horizontal plane. Any displays or signage, would extend downwardly below the drop ceiling within such installations. For many reasons, a business may not desire to, or may not be allowed or able to, install any structure above the drop ceiling. For example, added significant structural members extending above the drop ceiling may interfere with air vents, wiring, and other installations concealed between the structural ceiling and the drop ceiling. This can further complicate installation of heavy or bulky displays and signage or other structures.

Furthermore, with such environments having a large number of such signs or displays, the cost is also a factor that is considered for determining the types of displays or signage that is used. For example, complicated designs that are expensive to erect and/or hang can often be cost prohibitive.

Furthermore, certain signage is use for POP (Point of Purchase) displays that may have an in-store life that is more temporary, and is typically considered to be a display or sign that will be changed more frequently. Temporary displays may be used when the volume of expected sales of the merchandise being promoted is uncertain, such as when introducing a new line of products, or for seasonal products and for products associated with current vendor promotions.

Because the lifespan of a temporary display is limited, it is preferable to have temporary displays that are relatively inexpensive to build and to set up and tear down and/or change.

Even with cost and weight factors involved, the aesthetic features of signage also play a role in determining if the signage is appropriate. Inexpensive cost and quick fabrication and set up cannot override the need for attractive signage and displays.

Thus, there is a need for systems and methods that provide a robust and attractive display or sign that can be quickly and easily erected and torn down or changed. There is also a need for displays that are light weight and relatively inexpensive to fabricate and install. Still further, there is a need for display structures that are aesthetically pleasing and provide the desired marketing or advertising features.

SUMMARY OF THE INVENTION

A signage panel system comprises a panel element and a base element. The panel element has at least one tab formed on an edge and the tab including a slot formed therein. The base element including at least one channel formed therein wherein the channel is configured to receive the tab of the panel element when the panel element engages with the base element. A planar slide lock element fits into the tab slot of the panel element and slides in the tab slot. The channel has a wide section and a narrow section adjacent the wide section, the tab configured for engaging the channel with the slide lock element positioned in the wide section of the channel. The slide lock element sliding in the tab slot and in the channel to engage the narrow section and secure the panel element with the base element.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
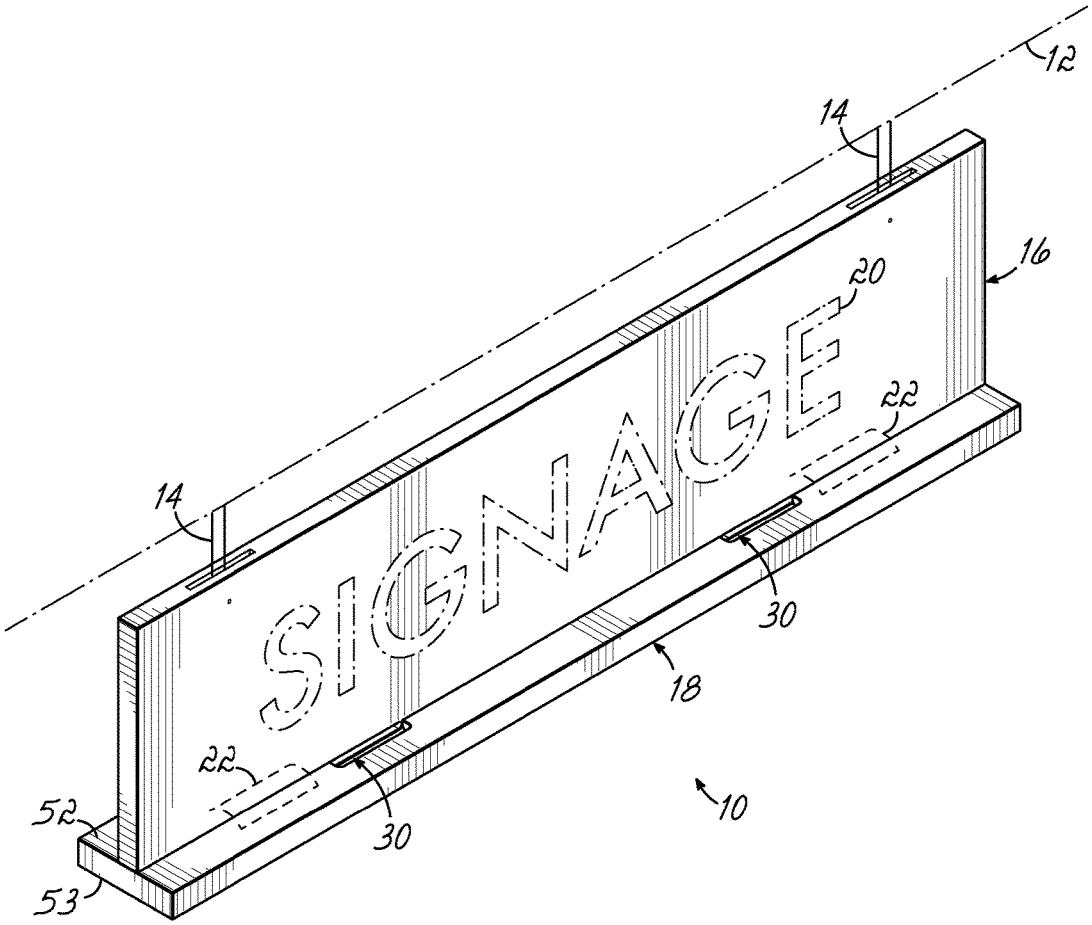
FIG. 1 is a perspective view of a signage panel having a base in accordance with one aspect of the invention.
Figure 2:
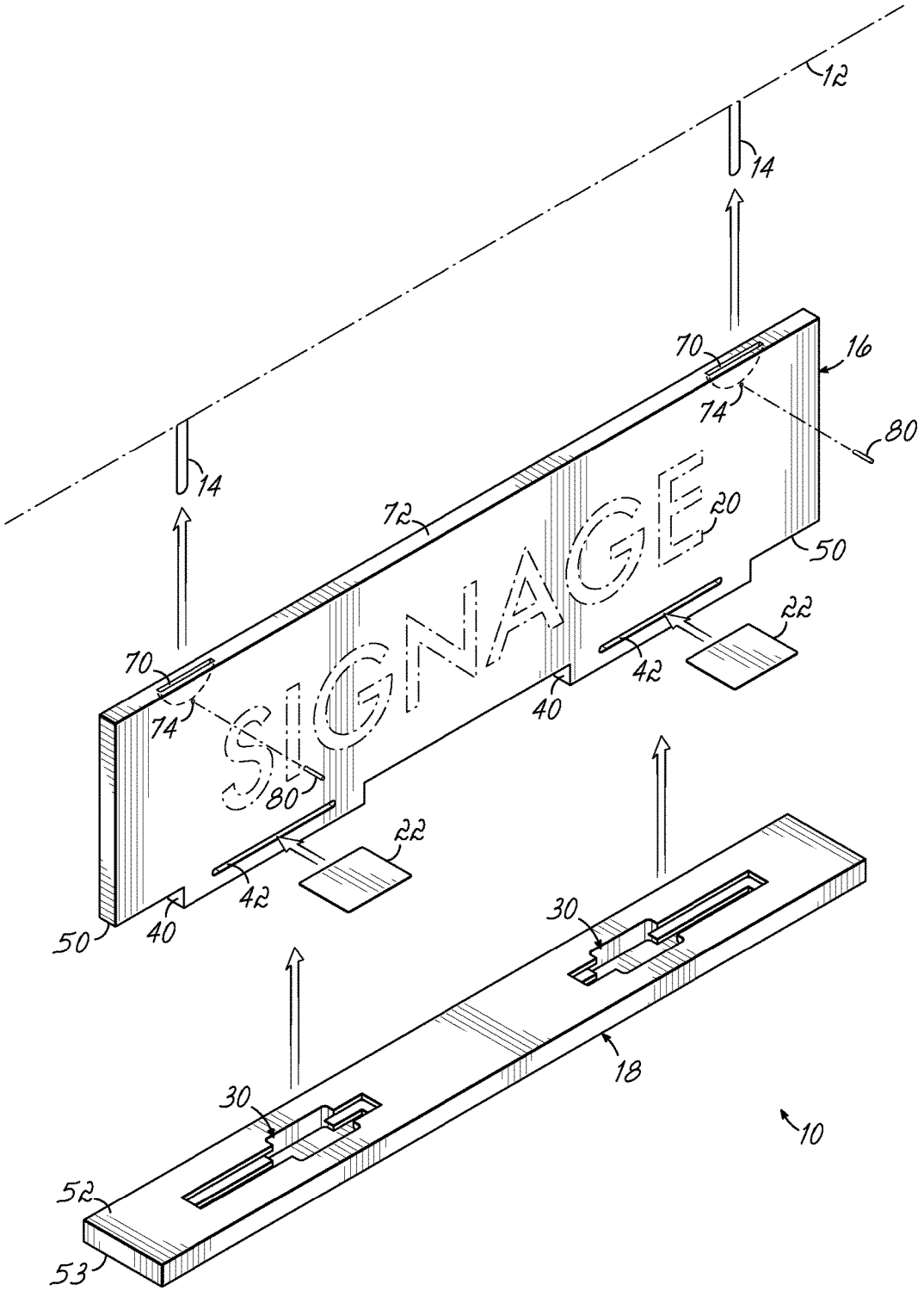
FIG. 2 is a perspective disassembled view of the assembled signage panel of FIG. 1.

FIG. 1 illustrates an assembled embodiment of the invention wherein the signage panel system 10 is suspended from the ceiling service 12 by suitable lanyard elements 14 that engage a panel element 16 of the system 10. The panel element 16 interfaces with a base element 18 and the entire system may be used to provide signage with appropriate graphics 20 as illustrated. FIG. 2 illustrates a system 10 partially disassembled wherein the panel element is shown separated from the base element 18. One or more planar slide lock elements 22 are used for coupling the panel elements and base elements together into the completed system is illustrated in FIG. 1. As discussed herein, the slide lock elements 22 engage various structures and features in both the panel element 16 and base element 18 to complete the system. Specifically, referring to FIGS. 2 and 3, the base element 18 is shown having one or more channels 30 formed therein. In one embodiment of the invention, the panel element 16 and base element 18 are formed of laminated foam board. For example, a 2 inch thick laminated foam board might be used. To that end, the channels 30 may be cut or machined out of base element 18, such as by cutting through laminate layer 32 and into the foam core 34. The panel element might have various dimensions and in one embodiment might be 1.5 feet high by 6 feet long. The base element might have a similar length to match the length of the panel element and may be 8 inches wide. Of course the invention is not limited to particular dimensions.

Figure 3:
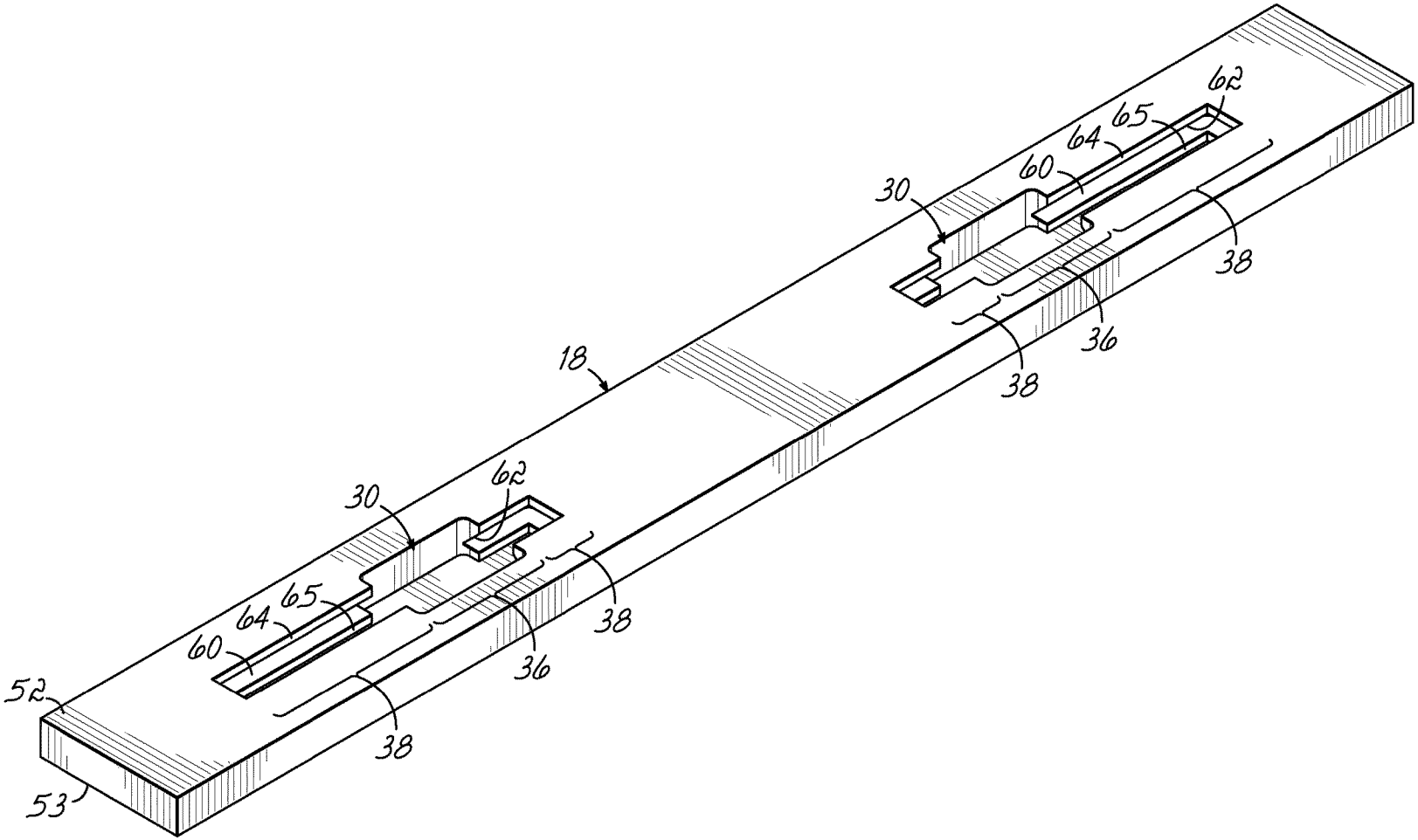
FIG. 3 is a perspective view of a base for use with the signage panel of FIG. 1.

Each channel 30 has one or more wide sections 36 adjacent to one or more narrow sections 38. More specifically, the wide sections 36 are wider in width or lateral dimension in the base element than the narrow sections 38. In one embodiment, a suitable dimension for the wide section 36 and a suitable dimension for the narrow section might vary based upon the size of the signage panel and base. In the embodiment illustrating the invention as shown in FIGS. 2 and 3, the base element is somewhat elongated and thus includes two channels 30 that extend longitudinally along the length of the base element at different positions. Each of the channels 30 includes a wide section 36 with one or more adjacent narrow sections 38. In the embodiment illustrated in the figures, two narrow sections 38 form part of each channel. One of the narrow channel sections 38 is longer than the other as illustrated although that is not limiting to the invention.

Turning again to FIG. 2, each of the panel elements 16 includes one or more tab portions 40 that extend from an edge of the panel element 16. Each of the tab portions 40 includes a slot 42 that is formed therein to extend laterally with respect to the tab portions or from a front face to a back face in the panel element. As discussed further herein, the slide lock elements 22 fit into the slots 42 and slide therein for coupling the base element and panel element together.

Figure 4:
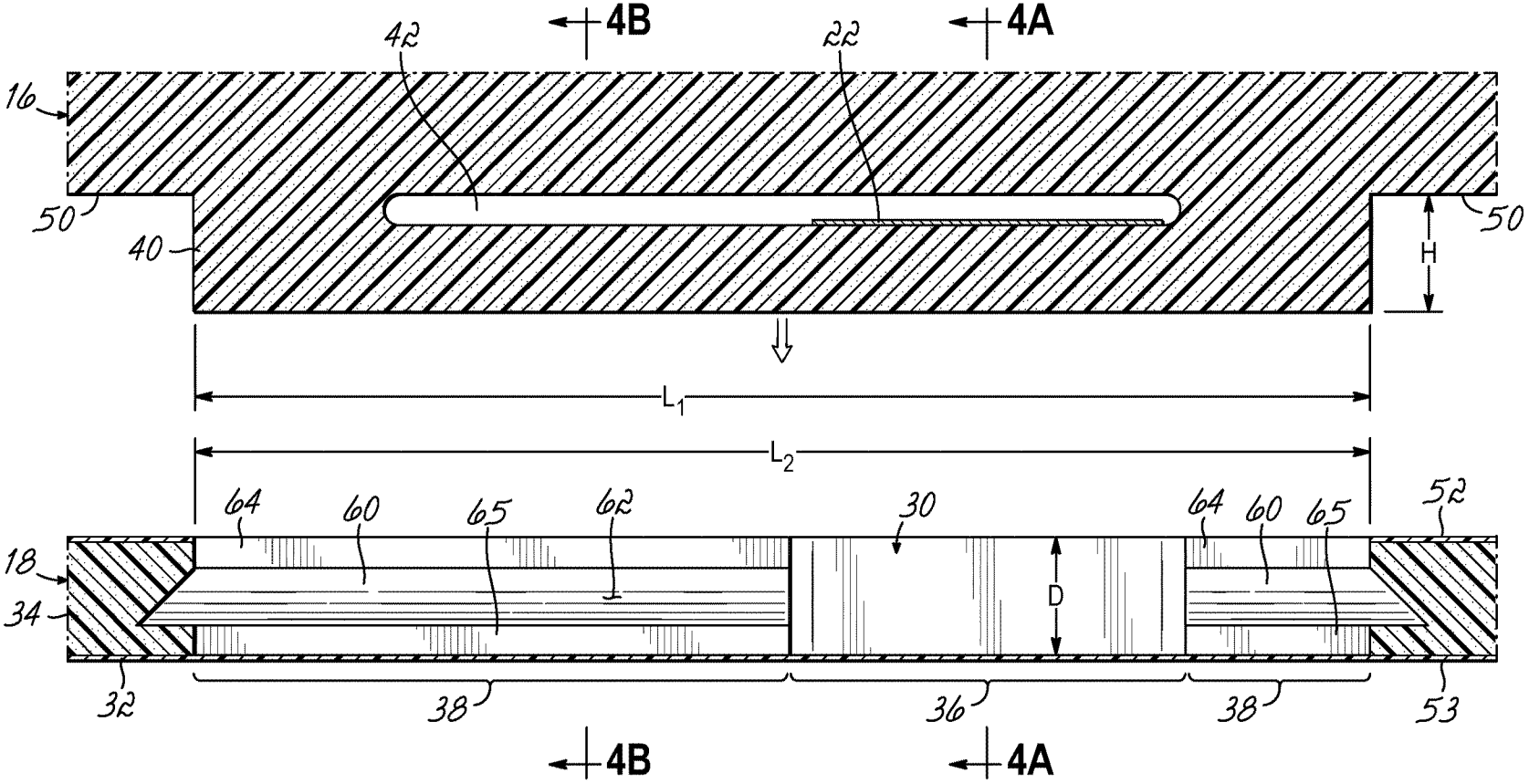
FIG. 4 is a side view, in partial cross-section, of a panel element prior to engagement with a base element.
Figure 4B:
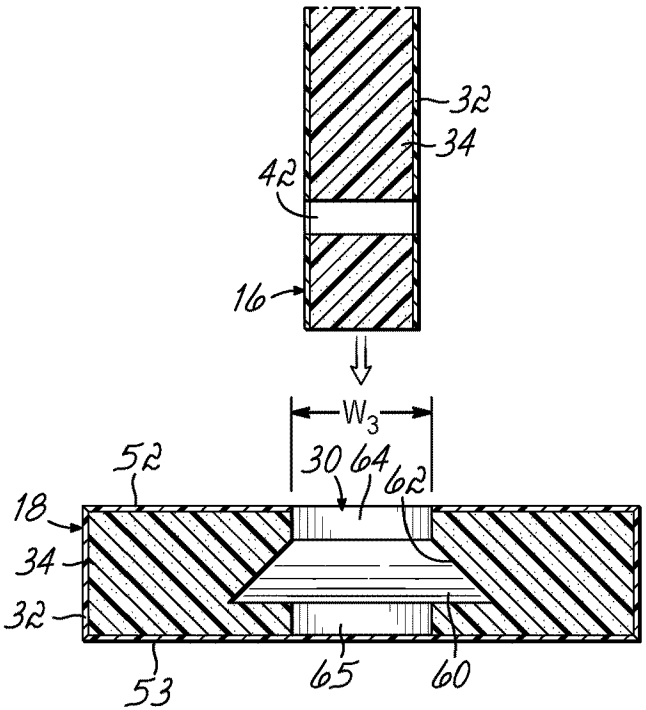
FIGS. 4A and 4B are partial cross sectional views, respectively along lines 4A-4A and 4B-4B of FIG. 4 showing a panel element prior to engagement with a base element.
Figure 4A:
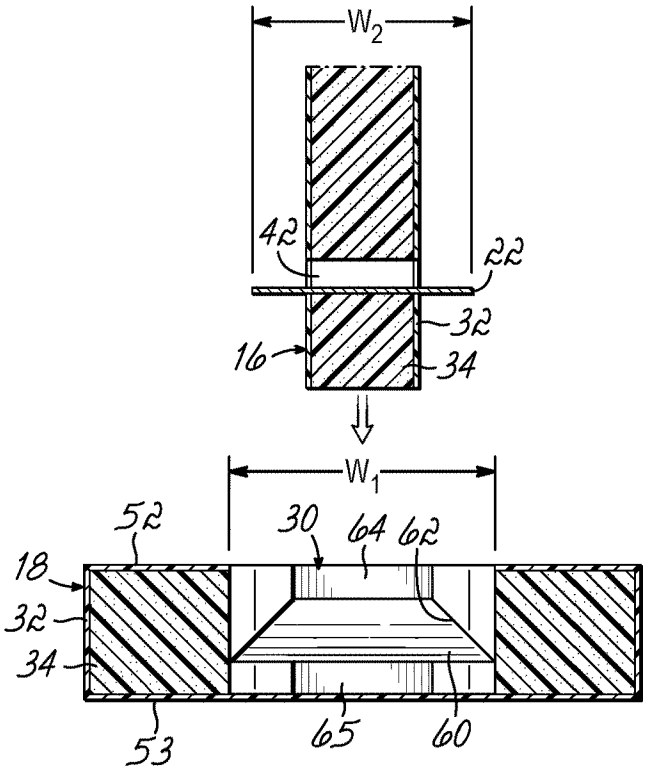

Turning to FIGS. 4*a*-4*b*, the engagement between the panel element 16 and base element 18 is illustrated. The panel element 16 is positioned over the base element 18 such that the tab portions 40 align with the channels 30. In that way, as illustrated by FIG. 4, the panel element can be slid downwardly into the base element 18 so that the channels 30 receive the respective tabs 40. Generally, for a good fit, the length L1 for tab portions 40 will match up with the length L2 of the channels.

In accordance with one aspect of the invention, the tab portions 40 as well as the channels 30 are configured to have similar cross-sectional shapes. In the illustrated embodiments, the cross-sectional shapes are rectangular. As such, as illustrated in FIGS. 4*a* and 4*b*, the tab portions 40 fit somewhat snugly within various channels 30. Of course, the tabs and channels might be formed to have other cross-sectional shapes without deviating from the invention. In the illustrated embodiment, multiple tab portions and channels are used but other embodiments might use a single tab portion and channel or a greater number depending on the overall length of the signage panel.

Each of the tab portions 40 will also have a height H that corresponds with the depth D of the channels 30. In accordance with one aspect of the invention, the height H and depth D will be somewhat similar such that a bottom surface 50 of the panel 16 is proximate to or in contact to the top surface 52 of the base element 18.

Referring again to FIGS. 4*a*-4*b*, the top surface 52 or face surface of the base element 18 has the channel formed therein to extend essentially a depth D below the face surface 52. Channel 30 has a portion of the channel that has a cross-sectional shape varying from other portions of the channel. Specifically, as illustrated in FIGS. 4*a*-4*b*, portion 60 that is in the narrow sections 38 of the channel has a cross-sectional shape with a width dimension that increases in width with the increasing depth of the channel in that portion 60. That is, the width dimension increases with an increase in depth in the channel and so the width of the channel portion 60 starts out narrower as reflected by the narrow section 38 and then increases in width as the depth increases into the narrow section. To that end, as illustrated in the figures, the sides 62 of the channel portion 60 might be sloped downwardly and laterally in the channel portion thus forming a channel that increases in width proceeding from a position proximate to the top face surface 52 of the base element to a position proximate to the bottom surface 53. In one embodiment of the invention, the channel portion 60 has a cross-sectional shape that, in cross-section, essentially forms a dovetail socket 60 or portion. Other portions of the channel 64,65 above and below the portion 60 might generally have straight walls and therefore a somewhat consistent width that essentially would define the width dimension of the narrow section 38 of the channel. The location of the channel portion 60 and its depth from with respect to the top and bottom surfaces 52, 53 might vary based upon the location of the slot 42 and the slide lock element that moves therein. As noted below, the function of the channel portion and its location is to require flexing of the slide lock element for engagement so that a force is created to drive the panel element 16 into the base element and vice versa.

As illustrated in FIGS. 4*a*-4*b*, the panel element is slid into the base element with the slide lock element 22 fitting into the wide section 36 of the channel. The width dimension $W_1$ is wide enough to accommodate the width of the slide lock element so that the tabs of the panel 40 may settle into the channels 30. FIG. 4*a* illustrates that the wide section 36 of the channel 30 can accommodate the planar slide lock element. Once the panel element is positioned in the base element, the panel element can be secured in accordance with the invention.

Figure 5:
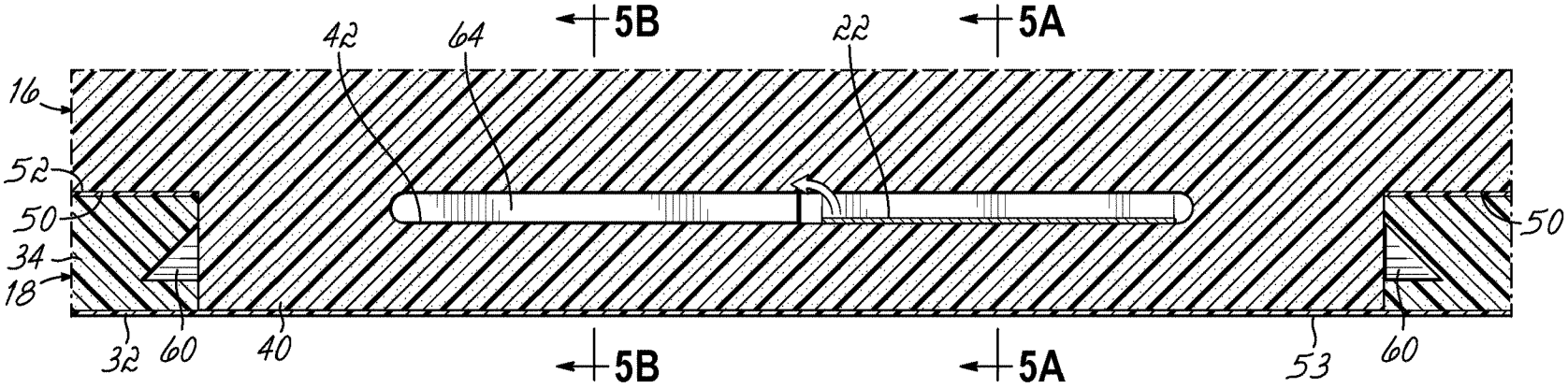
FIG. 5 is a side view, in partial cross-section, of a panel element in engagement with a base element.
Figure 5B:
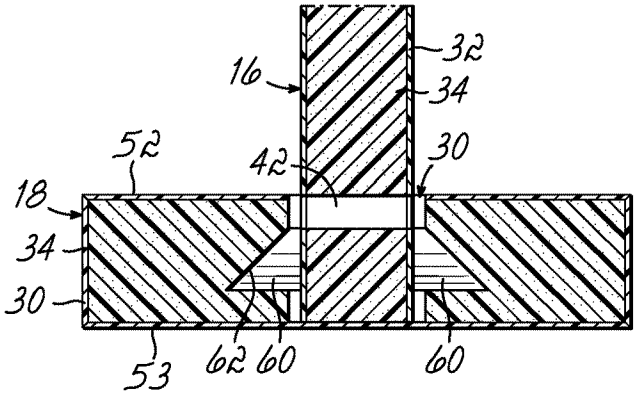
FIGS. 5A and 5B are partial cross sectional views, respectively along lines 5A-5A and 5B-5B of FIG. 5 showing a panel element in engagement with a base element.
Figure 5A:
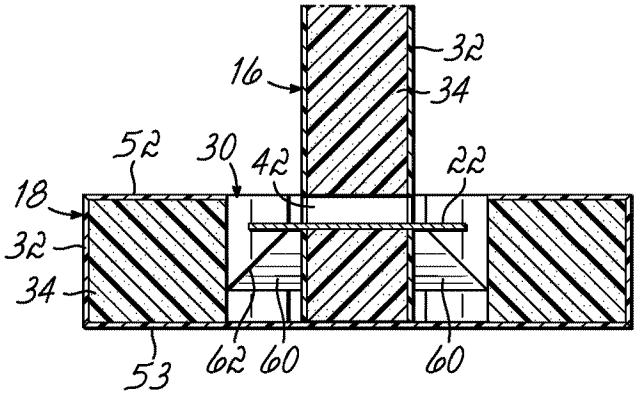

Specifically, as illustrated in FIGS. 5*a*-5*b*, the slide lock element 22 is configured for sliding in the tab slot 42 and also sliding in the channel 30. In that way, the slide lock element 22 starts in the wide section 36 and can slide in either direction in the channel to engage the narrow section 38 of the channel for securing the panel element with the base element. More specifically, the slide lock element is dimensioned with a width $W_2$, and it can be accommodated by the wide section 36 of the channel. Generally the width $W_2$ might be similar to the width $W_1$ of the wide section of the channel but does not have to be exactly the same. But width $W_2$ is wider than the width $W_3$ of the narrowed section of the channel. In sliding from the wide section to the narrow section, the slide lock element 22 flexes downwardly or toward the bottom of the channel 30 and thereby follows the sides 62 in the channel portion 60. The narrow section 38 and specifically the channel portion 60 of the narrow section then retains the flexed slide lock therein. As such, once the slide lock element has been slid over into the narrow section 38 of the channel, it will hold the panel element and the base element together.

Figure 6:
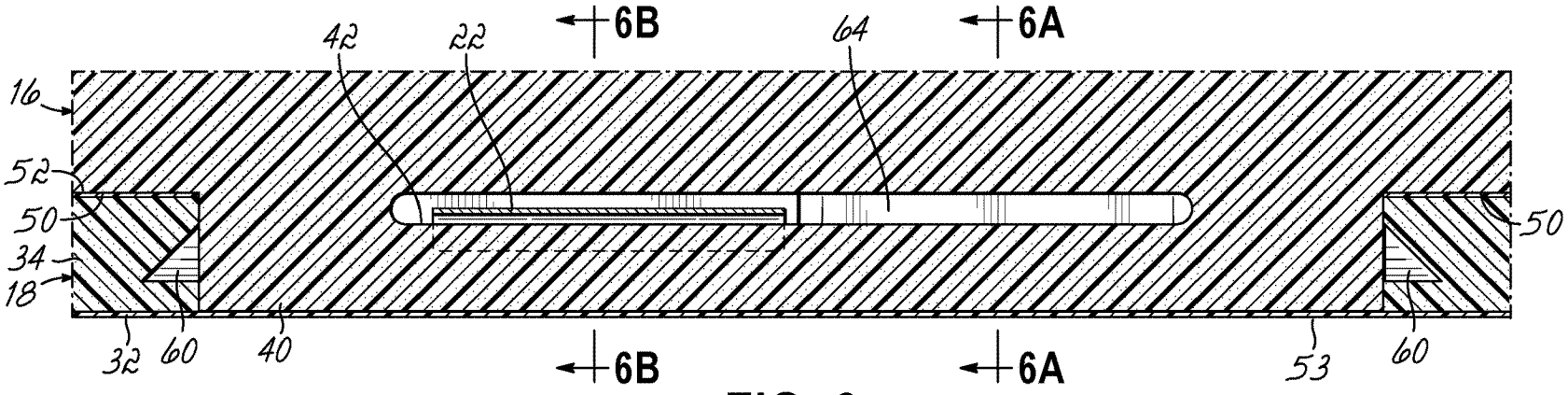
FIG. 6 is a side view, in partial cross-section, of a panel element in engagement with a base element with a slide-lock element moved to an engagement position.
Figure 6B:
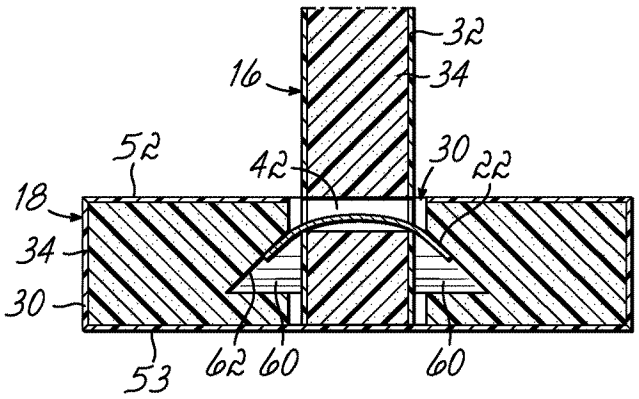
FIGS. 6A and 6B are partial cross sectional views, respectively along lines 6A-6A and 6B-6B of FIG. 6 showing a panel element secured in engagement with a base element.
Figure 6A:
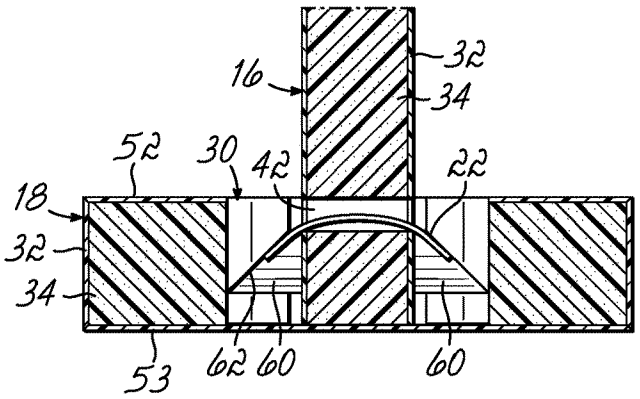

More specifically, referring to FIGS. 6*a*-6*b*, the slide lock element is slid in the tab slot 42 of the panel from the wide section 36 of the channel to the narrow section 38 of the channel. In engaging the narrow section 38 of the channel, the slide lock element 22 is flexed to fit into the portion 60 of the channel that has a cross-sectional shape having an increasing width dimension as the depth increases. In one embodiment of the invention, the planar slide lock element is formed of a flexible material, such as EPVC. Other types of materials might also be utilized for flexing. Slide lock elements should be somewhat flexible but also stiff or rigid enough to flex but also to still secure the panel element with the base element. To that end, the slide lock element may have a thickness of approximately 0.5-1.5 mil. The slide lock element could have a width of from 2-5 inches and a length of from 3-6 inches. However, such dimensions can be varied depending upon the size and shape of the panel element and base element as well as the dimensions of the channel and the tab slot. Referring to FIGS. 6*a*-6*b*, the slide lock element 22 is slid from the wide section of the channel to the narrow section and simultaneously is flexed at its side edges as illustrated in FIGS. 6*a*-6*b* so that it may fit into the narrow section. It is flexed so it may specifically fit into the portion of the channel having a width dimension that increases with the depth of the channel, referred to as portion 60, and may slide along the sides 62 or side surfaces in the channel portion 60. As seen in FIG. 3, the width $W_3$ that defines the narrow section 38 opens up into an effective wider width in portion 60 as the slide lock element is flexed downwardly to engage portion 60 and sides 62. But in order to fit into the narrow section 38 and move into portion 60, the slide lock element has to flex downwardly in the channel 30. Because of the gradual widening of portion 60 with the increased depth in the channel 30, the slide lock element does not have to flex to the width $W_3$ but only had to flex sufficiently to slide into the narrow portion 60. The slide lock element is flexed downwardly at its side edges to fit into portion 60 and slide along the length of portion 60 and sides 62 as the slide lock element is slid in the direction as indicated in FIG. 5. Then the flexed slide lock element is positioned to rest within the narrow section 38 of the channel in a flexed position.

Referring to FIGS. 6*a*-6*b*, the flexed slide lock element 22 still has an effective width that is wider than the width $W_3$ of the narrow section, and particularly wider than the portions 64 and 65 above and below the channel portion and which effectively define the width of the narrowed portion (See FIGS. 4-4B). The flexed edges of the slide lock element engage with the sloped sides 62 for channel portion 60 and simultaneously push down on the panel element 16 at the respective tab slots 42. The location of the tab slots 42 within the tabs 40 and the position of the bottom of the slot 42 with respect to the channel portion 60 preferably is dimensioned so the slide lock element, at rest, is at or near the top of the channel portion as shown in FIGS. 5-5B. Therefore, the slide lock element is required to flex to fit into the portion 60 of the narrowed section of the channel. In that way, a spring force is presented that acts against the walls 62 of the narrow section 38 and against the bottom of the slot 42 to drive the panel element downwardly into the base element as illustrated in FIGS. 5*a*-6*b*.

In that way, the present invention provides a signage or decorative panel system which is lightweight and cost efficient and which eliminates the need for typical fasteners and screws and other hardware. The panel system may be shipped in separate elements, and then assembled on site to create the finished product. While the illustrated embodiment shows a larger panel element and a smaller base element that are coupled together, the present system is not limited to such dimensions or layouts. Rather, other elements of differing sizes and shapes may be coupled together utilizing the unique channel and planar slide lock elements and features in accordance with the invention. Furthermore, while the illustrated embodiment shows the channel having a wide section and a usable narrowed section adjacent to one end thereof, the narrowed section may be positioned on either end of the wide section so that the slide lock element may be slid in either direction.

Figure 7:
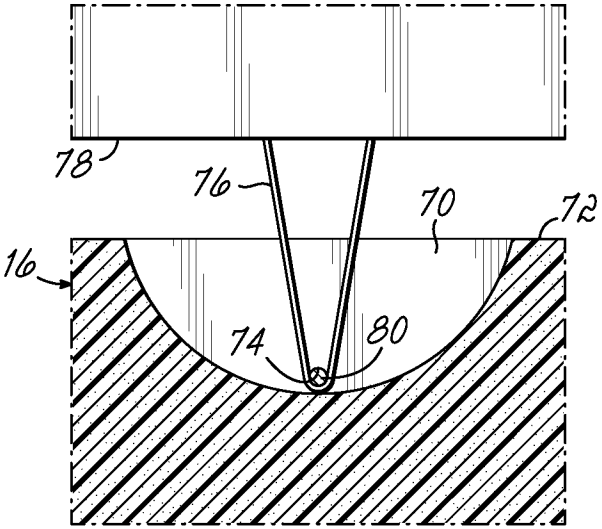
FIG. 7 is a partial cross-sectional view of a portion of a panel element of the signage panel secured to a ceiling.

In accordance with another feature of the paneled system 10, it might be suspended from a ceiling surface, or some other surface. Referring to FIG. 7, panel element 16 may be formed to include slots 70 formed in one or more positions along the top edge 72 of the panel element. Those slots 70 may be configured to receive a lanyard structure 76 suspended from a ceiling surface 78 or other appropriate surface. One or more apertures 74 may be formed in panel 16 proximate to slots 70 and a pin 80 or other fastener may be directed through the aperture 74 to engage with the lanyard 76. The aperture 74 spans through panel 16 across the slot 70 and thus the pin 80 will also span the slot 70 to engage both sides of the panel and the lanyard 76 and thus secure panel 16 and the entire system 10 from surface 78. In that way, the panel system may be used for signage purposes or decorative purposes being suspended from a ceiling surface 78. Of course other ways of suspending the signage panel system of the invention might be used.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. For example, although the exemplary embodiments of the invention illustrated in the previous figures are shown with a channel portion 60 having a dovetail cross-sectional shape with straight angled sides 62, persons of ordinary skill in the art will understand that many cross-sectional shapes may be used and the shape of the sides of side surfaces 62 might vary as long as the width of the channel portion 60 starts narrow at one depth in channel 30 and increases in width as the depth increases in the channel. In that way, a flexed slide lock element could be retained. Therefore, the invention in its broader aspects is not limited to the specific details of the representative apparatuses and methods, and illustrative examples shown and described. Accordingly, departures may be made from such details without departure from the spirit or scope of applicant's general inventive concept.

What is claimed is:

1. A signage panel system comprising:

a panel element;

a base element;

the panel element having at least one tab formed on an edge thereof, the tab including a tab slot formed therein;

the base element including at least one channel formed therein, the channel configured to receive the tab of the panel element when the panel element engages with the base element;

a planar slide lock element configured to fit into the tab slot of the panel element and slide in the tab slot;

the channel having a wide section and a narrow section adjacent the wide section, the tab configured for engaging the channel with the slide lock element positioned in the wide section of the channel;

the slide lock element configured for sliding in the tab slot and in the channel to engage the narrow section and secure the panel element with the base element.

2. The signage panel system of claim 1, wherein the base element includes a face surface with the at least one channel formed to extend to a depth below the face surface, the at least one channel having a cross-sectional shape with a width dimension that increases with the depth of at least one channel.

3. The signage panel system of claim 2, wherein said cross-sectional shape of at least one channel forms a dovetail socket.

4. The signage panel system of claim 1, wherein the slide lock element is flexible and configured to flex when it engages the narrow section of at least one channel.

5. The signage panel system of claim 1, further comprising multiple narrow sections, at least one of the multiple narrow sections positioned proximate opposite ends of the wide section of the at least one channel, the slide lock element configured for sliding in the at least one channel to one of the multiple narrow sections on either of the opposite ends of the wide section for securing the panel element with the base element.

6. The signage panel system of claim 1, wherein at least one of the panel element or the base element are made of foam board having a foam core and skin.

7. The signage panel system of claim 6, wherein the channel in the base element is formed through the skin of one face surface and into the foam core.

8. The signage panel system of claim 1, wherein a width of the slide lock element is wider than a width of the panel element, the slide lock element extending to either side of the tab slot for engaging the narrow section of the channel on both sides of the channel.

9. The signage panel system of claim 1, wherein the base element includes a face surface with the at least one channel formed to extend to a depth below the face surface, the tab slot of the panel element being positioned below the face surface of the base element for the slide lock element to slide below the face surface.

10. A system for connecting board elements comprising:

a first board element;

a second board element;

the first board element having at least one tab formed on an edge thereof, the tab including a tab slot formed therein;

the second board element including at least one channel formed therein, the channel configured to receive the tab of the first board element to couple the first and second board elements together;

a lock element configured to fit into and slide in the tab slot of the first board element;

the channel having a wide section and a narrow section adjacent the wide section, the tab of the first board element configured for engaging the second board element channel with the lock element positioned in the wide section of the channel;

the lock element configured for sliding in the tab slot and in the channel to engage the narrow section and secure the first board element with the second board element together.

11. The system of claim 10, wherein the second board element includes a face surface with the at least one channel formed to extend to a depth below the face surface, the at least one channel having a cross-sectional shape with a width dimension that increases with the depth of the channel.

12. The system of claim 11, wherein said cross-sectional shape of the channel forms a dovetail socket.

13. The system of claim 10, wherein the lock element is flexible and configured to flex when it engages the narrow section of the channel.

14. The system of claim 10, further comprising multiple narrow sections, at least one of the multiple narrow sections positioned proximate opposite ends of the wide section of the at least one channel, the lock element configured for sliding in the at least one channel to at least one of the multiple narrow sections on either of the opposite ends of the wide section for securing the first and second board elements together.

15. The system of claim 10, wherein at least one of the first and second board elements is a foam board having a foam core and skin.

16. The system of claim 15, wherein the channel in the second board element is formed through the skin of one face surface and into the foam core.

17. The system of claim 10, wherein a width of the lock element is wider than a width of the first board element, the lock element extending to either side of the tab slot for engaging the narrow section of the channel on both sides of the channel.

18. The system of claim 10, wherein the second board element includes a face surface with the at least one channel formed to extend to a depth below the face surface, the tab slot of the first element being positioned below the face surface of the second board element for the lock element to slide below the face surface.

* * * * *